US005583555A

United States Patent [19]

Tabasso

[11] Patent Number: 5,583,555

[45] Date of Patent: Dec. 10, 1996

[54] EQUIPMENT FOR PRINTING AN IMAGE ON AN ARTICLE

[75] Inventor: Giovanni Tabasso, Pino Torinese, Italy

[73] Assignee: Eidos S.p.A., Chieri, Italy

[21] Appl. No.: 253,142

[22] Filed: Jun. 2, 1994

[30] Foreign Application Priority Data

Jun. 2, 1993 [EP] European Pat. Off. ..... 93108851

[51] Int. Cl.[6] ..... B41J 2/325

[52] U.S. Cl. ..... 347/213; 347/171

[58] Field of Search ..... 347/171, 197, 347/213, 217; 400/56, 120.01

[56] References Cited

U.S. PATENT DOCUMENTS

| | | | |
|---|---|---|---|
| 4,949,098 | 8/1990 | Gluck et al. | 347/197 |
| 5,053,788 | 10/1991 | Tohdo | 347/217 |
| 5,416,500 | 5/1995 | Tohdo | 347/171 |

FOREIGN PATENT DOCUMENTS

| | | | |
|---|---|---|---|
| 0467141 | 1/1992 | European Pat. Off. . | |
| 3935345 | 4/1991 | Germany . | |
| 62-41058 | 2/1987 | Japan | 347/213 |
| 62-158091 | 7/1987 | Japan . | |

*Primary Examiner*—Benjamin R. Fuller
*Assistant Examiner*—L. Anderson
*Attorney, Agent, or Firm*—Sughrue, Mion, Zinn, Macpeak & Seas

[57] ABSTRACT

A positive image is formed on one face of a ribbon by means of a selective thermal transfer of ink with the use of a thermal dot-line or dot-matrix printing head. The positive image is then transferred from the ribbon to an article with the use of a heating pad.

10 Claims, 9 Drawing Sheets

EQUIPMENT FOR PRINTING AN IMAGE ON AN ARTICLE

BACKGROUND OF THE INVENTION

The present invention relates to a method of printing an image on an article such as a container or a wrapper for a product or a package.

In the description and in the following claims, the term "image" means, in a broad sense, a text, a drawing, a logo, a bar code, or any other two-dimensional graphic representation.

The application of codes (for example bar codes) and/or images of various types to wrappers for products in order to identify the product and/or to indicate, for example, its sale price and possibly other information is a widespread practice in industry and commerce.

Adhesive labels on which the codes and/or images have previously been printed are often used for this purpose.

This solution has various disadvantages from both economic and aesthetic points of view. Moreover, the labels may become detached or may be removed from the products, which is a further problem.

In order to code articles such as containers for products, it has also been proposed to pre-print the texts and/or codes onto the containers before the product is packaged (for example, by typography or silk-screen printing).

This solution has the disadvantage that it requires the provision, and hence the ORGANIZATION, of stocks of pre-printed containers or wrappers and may even involve considerable wastage when it is necessary to change the code associated with a particular article for which the container or wrapper is intended.

It has also been proposed to print codes and/or images of other types directly onto products which have already been wrapped, by the thermal transfer of ink from an inked ribbon.

If the shape and consistency of the packaged product allow, it is possible to use thermal transfer devices with printing blocks for this purpose. In order to print various images or codes, this solution involves the provision and ORGANIZATION of a corresponding set of printing blocks, since it is not possible to modify a printing block in real time during production. Moreover, it is not possible to use dot-line or dot-matrix printing heads, which are typically made of ceramic material, and hence are rigid, when the packaged product is of irregular shape and/or consistency or when the surface which is to receive the print is quite rough.

German patent DE-A-39 35 345 describes a printing method. In the method described in this document, the positive image is formed (possibly as a mirror image) on a portion of an auxiliary flexible ribbon by the thermal transfer of some of the ink carried on one face of an inked ribbon, by means of a dot printing head. The positive image thus formed is then transferred from the auxiliary ribbon to an article by means of a transfer device with a heated pad.

This method has various disadvantages.

In the first place, it can be carried out only with the use of an auxiliary ribbon which makes the equipment used more expensive and bulky.

Moreover, the transfer of the image onto the article necessarily takes place by means of a double transfer of ink, that is, from the inked ribbon to the auxiliary ribbon and then from the latter to the article.

In this connection, it should be noted that the most usual and economically most suitable inked ribbons typically comprise a substrate ribbon, for example, of mylar, on one face of which a layer of hot-melting (typically resin-based) ink is deposited with the interposition of a layer of a release agent. A film of a hot-melting adhesive, for example of the so-called "hot melt" type, is also deposited on top of the layer of ink.

With the use of an inked ribbon of this type, in the method according to DE-A-39 35 345, the ink transfers well from the inked ribbon to the auxiliary ribbon, but transfers badly from the auxiliary ribbon to the article. In fact, as a result of the first transfer, the ink is fixed firmly to the auxiliary ribbon by virtue of the adhesive which covers the layer of ink on the inked ribbon. The ink transferred to the auxiliary ribbon, however, is no longer covered by adhesive but, on the other hand, may have traces of release agent. The ink cannot, therefore, be anchored perfectly to the surface of the article during the second and final transfer. This may involve a decline in the quality of the image printed on the article and/or an image which is not sufficiently stable.

SUMMARY OF THE INVENTION

The object of the present invention is to propose a printing method of the type specified above which avoids at least some of the disadvantages of the method of the prior art described above.

In a first embodiment of the method, the positive image is formed on a portion of the inked ribbon by thermally transferring the portion of the ink on the said portion of the inked ribbon which corresponds to the negative of the image onto an auxiliary ribbon. The positive image is then transferred thermally from the portion of the inked ribbon to the article.

In this embodiment, the ink transferred to the article in fact undergoes a single transfer, that is, from the inked ribbon to the article and, with the use of an inked ribbon of the type described above, the layers of release agent and of hot-melting adhesive are deposited in an optimal manner for a precise and stable transfer of the ink to the article.

Alternatively, positive images may be formed on a portion of the other face of the inked ribbon by transferring the portion of the ink on a portion of the inked face which corresponds to the positive image onto a portion of the other face and then thermally transferring the positive image thus formed from the portion of the other face of the inked ribbon to the article. In this embodiment, the ink transferred to the article undergoes two transfers, as in the method according to the prior art, but it is not necessary to use an auxiliary ribbon.

In a further embodiment of the method, the positive image is formed on a portion of the inked face of the inked ribbon by transferring the portion of the ink which corresponds to the negative of the image onto a portion of the other face of the ribbon and then thermally transferring the positive image thus formed from the portion of the inked face of the ribbon to the article.

In this embodiment, there is the advantage that the ink transferred to the article undergoes a single transfer. A further advantage consists of the fact that it is not necessary to use an auxiliary ribbon.

Another subject of the invention is equipment for printing an image on articles by thermally transferring ink from a flexible inked ribbon, the characteristics of the equipment being defined in the appended claims.

Further characteristics and advantages of the invention will become clear from the detailed description which follows with reference to the appended drawings provided purely by way of non-limiting example, in which:

DETAILED DESCRIPTION OF THE INVENTION

Figure 1:
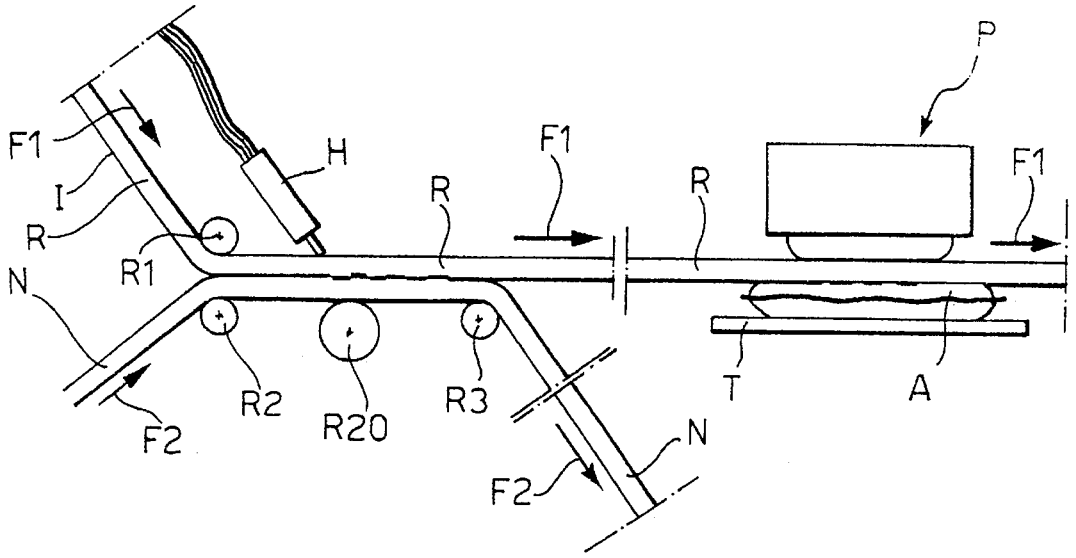
FIGS. 1 to 3 are schematic illustrations showing three different possible embodiments of the method of the invention.

In FIG. 1, a packaged article on which an image, for example, a bar code, is to be printed, is indicated A. The article is carried by a conveyor belt T which advances in steps or jerks, for example, in a direction perpendicular to the plane of the drawing.

In order to print the image on the article A, a first embodiment of the invention uses a flexible ribbon R, which is inked on one face and the thickness of which has been shown enlarged for greater clarity. The ribbon R is advanced (by means of known devices, not shown in FIG. 1) along a path indicated by the arrows F1.

In particular, the inked ribbon R is deflected in correspondence with a guide roller R1, downstream of which there is a thermal printing head H, for example, of the dot-line type. The inked ribbon R travels between the head and a counter-roller R20 with its non-inked face in contact with the printing head H.

An auxiliary, flexible, non-inked ribbon, indicated N, constituted, for example, by a mylar or polyester film, is advanced along a path indicated by the arrows F2. In the portions of its path between two guide rollers R2 and R3, the auxiliary ribbon N travels in contact with the inked ribbon R, particularly in the region in which the thermal printing head H is disposed opposite the counter-roller R20. The head is activated, under the control of a programmable computerized control system of known type, so as to form on the inked face of the ribbon R successive positive images for transfer further downstream onto individual articles A supplied in sequence by the conveyor T. Each positive image is formed by the selective heating of the individual spaced dots of the head H so as to transfer onto the auxiliary ribbon the portions of the ink of the inked ribbon R which correspond to the negative of the image to be printed on the articles A. In addition to the negative of the image, the same printing head H may also transfer onto the auxiliary ribbon the ink of the inked ribbon which is disposed between two successive positive images formed thereon.

In the explanatory diagram of FIG. 1, each positive image formed on the inked face of the ribbon R is shown as including three successive black portions or lines spaced at regular intervals along the ribbon.

Downstream of the printing head H, the path of the ribbon R extends above the path of the articles A.

The movement of the ribbon R and of the products A is controlled by synchronizing means of known type, not shown, so that, for each step of the conveyor T, a positive image formed on the ribbon R is disposed above an article A near a thermal transfer device, generally indicated P, with a heating pad. This device, possible embodiments of which will be further described below, presses against the article A and heats the portion of the ribbon R which bears the positive image to be printed so as to transfer it onto the article.

In the system of FIG. 1, the ribbons R and N are advanced along their respective paths at the same speed.

The use of a thermal transfer device with a heating pad enables the printing to be carried out even on articles of irregular shape and/or consistency and/or with uneven surfaces, in particular, even on "soft" packages, such as plastics bags and the like. The use of a dot-line (or possibly dot-matrix) thermal printing head thus enables the direct, on-line modification of the characteristics of the images or codes to be printed on the articles.

Figure 2:
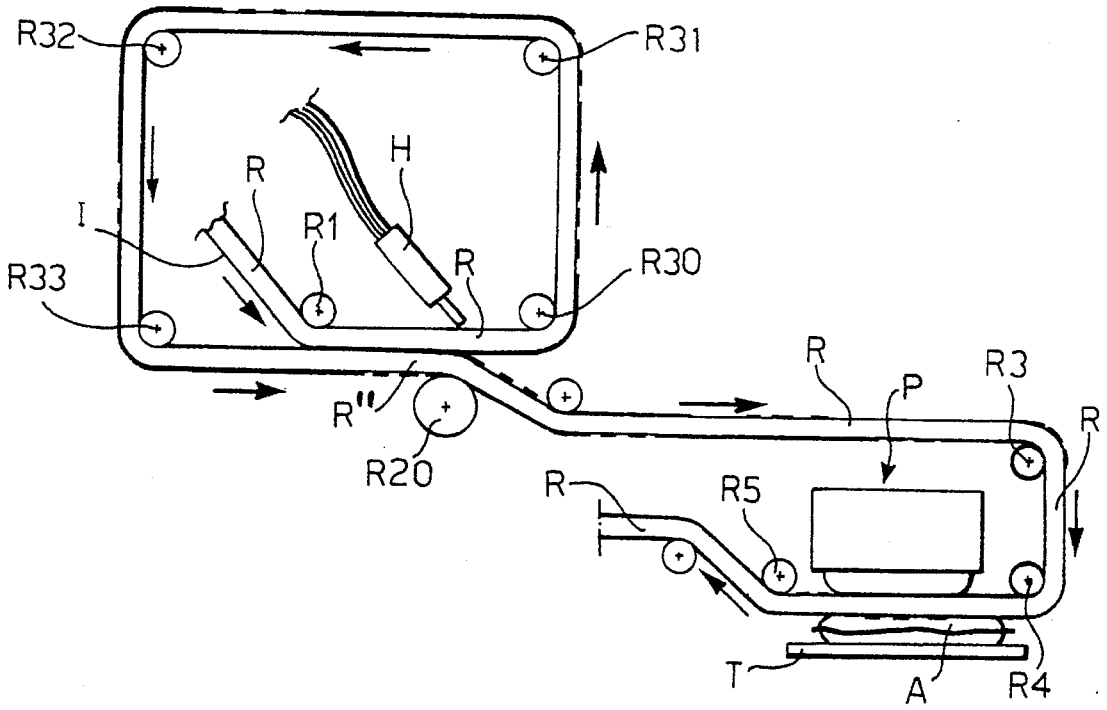

FIG. 2 shows schematically a different embodiment of the method of the invention. In this drawing, parts and elements already described with reference to FIG. 1 have again been given the same alpha-numeric references.

In the system according to FIG. 2, each individual positive image is formed on a portion of the non-inked face of the ribbon R by transferring the portions of the ink of a portion of the inked face which correspond to the positive image to a portion of that face.

In particular, the inked ribbon R passes firstly near to the printing head H, then follows a loop-like path defined by the guide rollers R30–R33, and then passes between the head H and the counter-roller R20 again, beneath and in contact with another portion of the same ribbon. Two superposed portions R' and R" of the same ribbon R thus pass between the head H and the counter-roller R20.

The head H transfers the portions of the ink which correspond to the positive of the images to be printed from the inked face of the portion R' to the non-inked face of R".

Downstream of the counter-roller R20 the images formed on the portion R" of the ribbon R are transferred to the articles A by means of the pad device P.

In the solution of FIG. 2, the surface of the counter-roller R20 and the active end surface of the pad transfer device P have to be cleaned periodically.

Figure 3:
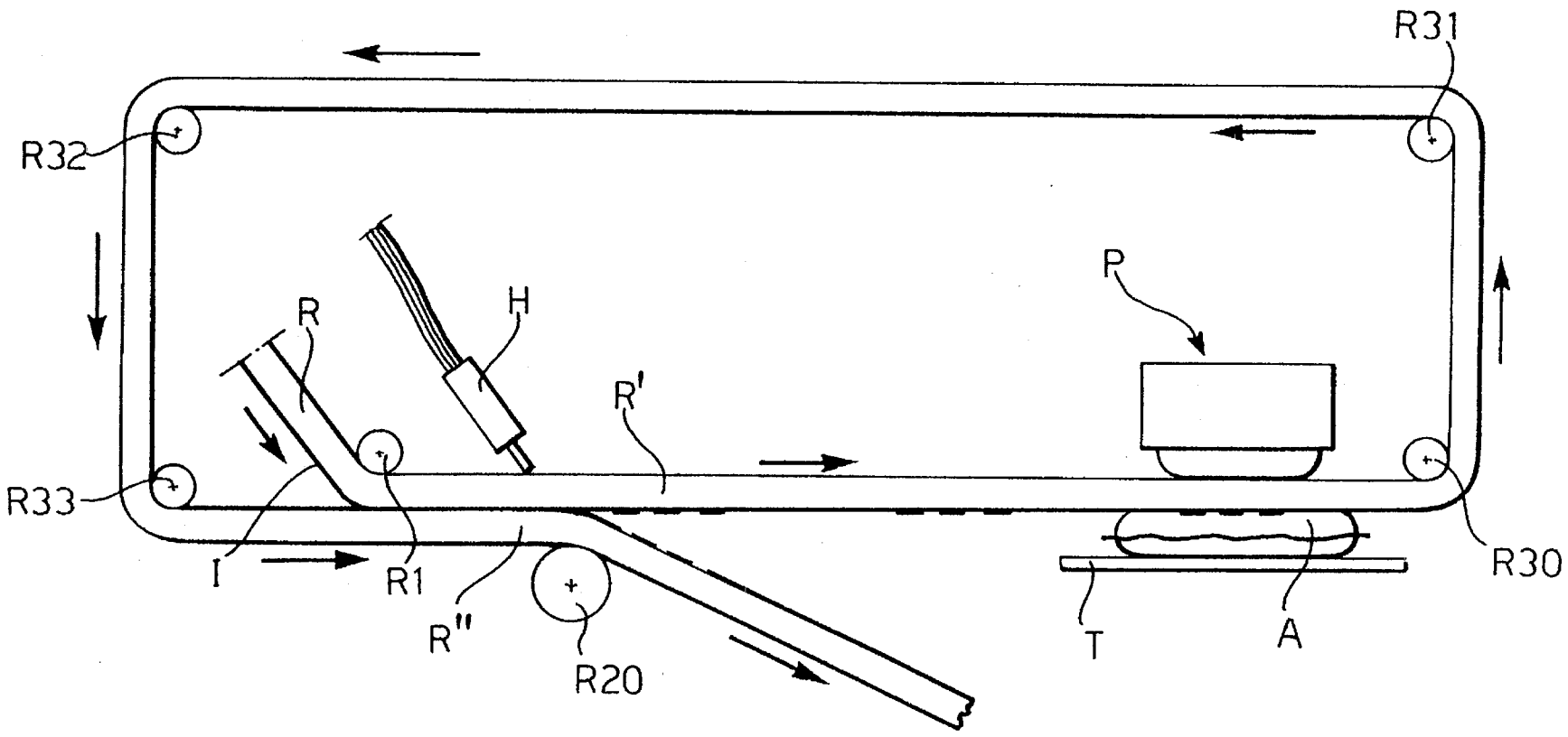

In the system shown in FIG. 3, the individual positive image to be printed on an article A is formed on a portion of the inked face of the inked ribbon R by transferring the portions of the ink which correspond to the negative of the image and to the spaces between adjacent images onto a portion of the other face of the same ribbon R.

The inked ribbon R comes from an unwinding roller or reel (not shown) to the guide roller R1 and then passes near the printing head H, continues along a substantially loop-like path defined by guide rollers R30–R33, and then passes between the head H and the counter-roller R20 again, beneath and in contact with another portion of the same ribbon. There are thus two portions R' and R" of the same ribbon R between the head H and the counter-roller R20 and the inked face of the portion R' is in contact with the non-inked face of the portion R". The head H is piloted so as to transfer the ink portions which correspond to the negatives of the images to be printed (and any spaces between successive images) from the inked face of the portion R' to the non-inked face of R".

Downstream of the printing head H, the images formed on the portion R' of the inked ribbon R are transferred onto the articles A by means of the pad device P.

Figure 4:
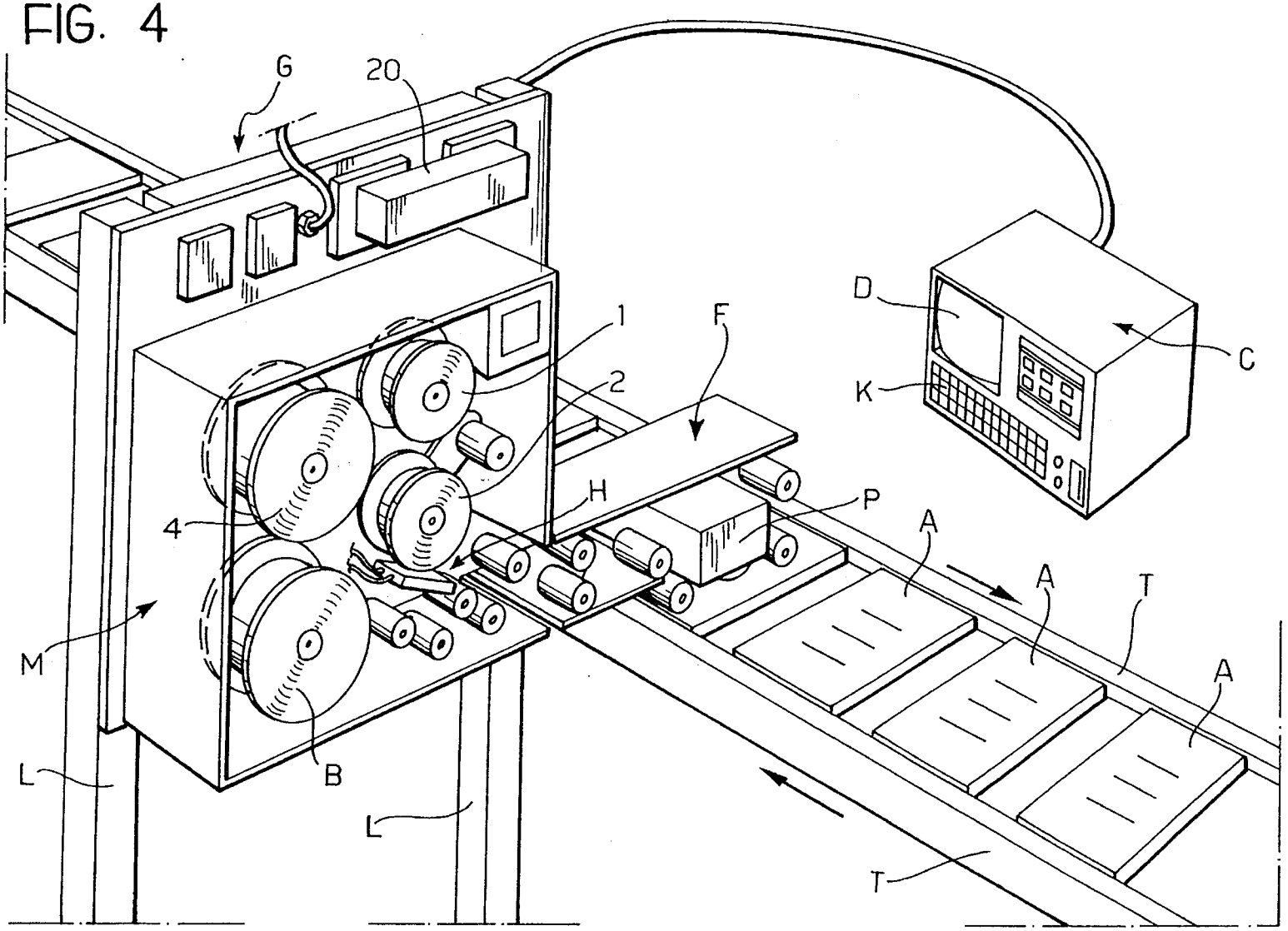
FIG. 4 is a perspective view of equipment usable for carrying out the method of the invention.

FIG. 4 shows equipment usable to carry out the thermal transfer printing method according to FIG. 1.

The equipment comprises a control console C with a video display D and a control keypad K.

The equipment also comprises a stationary portion, generally indicated G, comprising a support framework with two uprights L to which a structure M is connected, the printing units and the devices for supplying and moving the inked ribbon and the auxiliary ribbon being mounted therein.

As can be seen from FIG. 4, the framework G is positioned adjacent a conveyor T which carries the articles A in sequence with a stepped or jerky forward movement.

Figure 5:
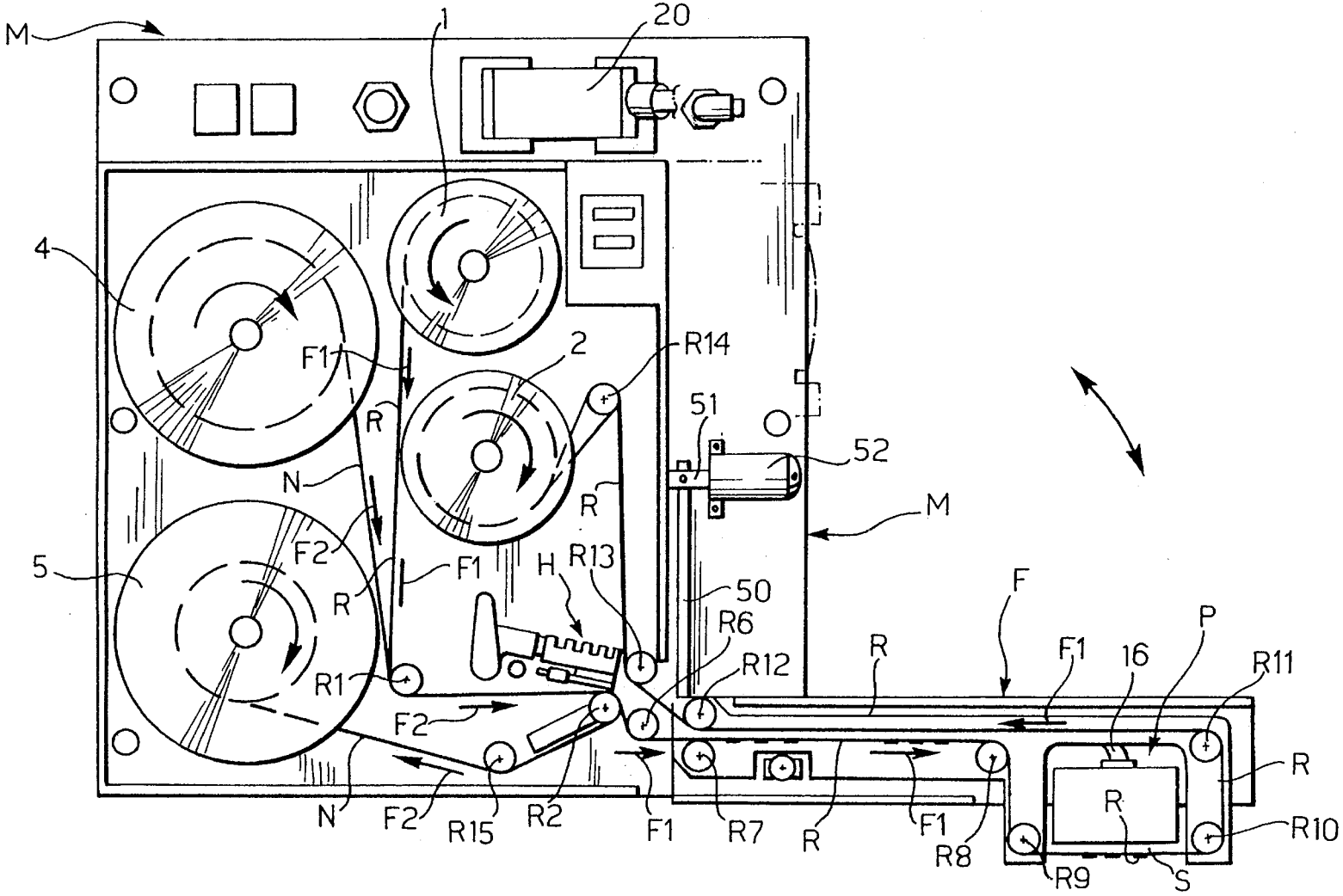
FIG. 5 is a front view of part of the equipment shown in FIG. 4 for carrying out the method of FIG. 1, FIG. 6 and 7 are sectioned views of a thermal transfer device with a heating pad, which forms part of the equipment according to the invention, in two different working conditions.

FIG. 5 shows the equipment of devices carried by the support structure M for carrying out the printing method described above with reference to FIG. 1. The structure contains a roller or reel 1 for unwinding the inked ribbon R and an associated motor-driven roller or reel 2 for rewinding the ribbon.

Starting from the unwinding roller 1, the inked ribbon R follows a path indicated by the arrows F1 and is deflected by a first guide roller R1 and then passes between a further guide roller R2 and the thermal dot-line printing head H. Downstream of the printing head, the inked ribbon R is deflected again by a roller R6 and then enters an arm F connected to the support structure M. Within the arm F, the ribbon R is caused, by deflecting and guide rollers R7–R11, to pass in front of the active surface S of a thermal transfer device P with a heating pad, carried by the arm.

Downstream of the guide roller R11, the inked ribbon R continues as far as a return roller R12 carried by the arm F and then emerges from the arm and continues towards the rewinding roller 2, passing over deflecting rollers R13 and R14.

The arm F extends above the conveyor T a short distance from the upper surfaces of the articles A and the active surface S of the pad transfer device P faces downwardly.

With reference to FIG. 5 in particular, the arm F is articulated on the support structure M so that it can pivot about an axis which is perpendicular to the plane of the drawing and extends between the return rollers R12 and R7.

One end of a rod 50 is connected to the end of the arm and its other end is articulated on the rod 51 of a pneumatic (or hydraulic) cylinder 52 which is fixed to the support structure M. The operation of the cylinder moves the arm F between a raised position (not shown) and a lowered position (shown in FIG. 5) in order to print on an article A a corresponding positive image formed on the ribbon R.

The operation of the cylinder 52 is controlled (in known manner) by control devices included in the console C.

Naturally, the arm F may be pivoted by known devices of other types, for example, by electromagnetically-operated actuators.

The support structure M also contains an unwinding roller or reel 4 for the auxiliary ribbon N and an associated motor-driven rewinding roller or reel 5.

Between these rollers, the auxiliary ribbon N follows a path indicated by the arrows F2. In particular, starting from the unwinding roller 4, the auxiliary ribbon N, is also deflected in correspondence with the guide roller R1 and then passes, together with the inked ribbon R, between the roller R2 and the thermal printing head H. Downstream of the roller R2, the ribbon N is deflected again in correspondence with a roller R15 and then reaches the motor-driven rewinding roller 5.

The motor-driven rewinding rollers 2 and 5 for the inked ribbon and for the auxiliary ribbon, respectively, are synchronized in known manner so that the ribbons R and N pass between the printing head H and the counter-roller R20 at the same speed.

If the ribbons R and N are made to follow the paths described above with reference to FIG. 5, the machine enables printing to be carried out according to the method described schematically above with reference to FIG. 1.

The control console C comprises electronic circuits for supplying and piloting the devices for driving the ribbons R and N, the cylinder 52 and the printing devices H and P carried by the support structure M.

These circuits may comprise a control unit formed, for example, with the use of a '286 type microprocessor for controlling the functions of the setting and storage of the data as well as the printing functions. The console may be equipped with a floppy-disc drive, an external keyboard of the type used for personal computers, possibly with a "mouse" incorporated for facilitating data-entry operations.

The console C may be equipped with a serial interface device, for example of the RS232 type, for connection to an external processor, if required.

In order to synchronize the operation of the printing equipment described above with the line for packing or producing the articles A, the console C conveniently has an opto-isolated digital input/output interface.

The microprocessor control unit of the console C may be programmed by known techniques so as to enable texts, bar codes, drawings and logos for printing to be set, stored and modified, possibly with guidance for the operator, with an immediate display in clear on the screen D of what is to be printed.

The machine shown in FIG. 5 can be modified by simple and obvious modifications to carry out the methods according to the invention described above with reference to FIGS. 2 and 3. In this case, of course, only one unwinding roller or reel and one rewinding roller or reel are required for the inked ribbon.

Figure 6:
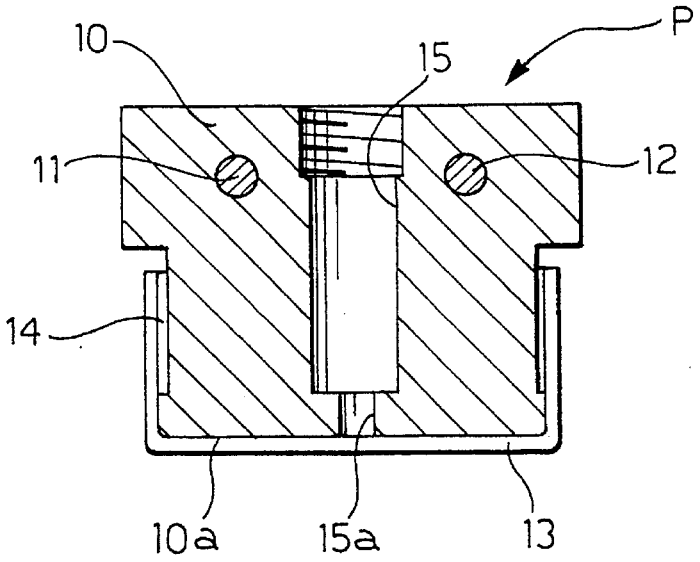
Figure 7:
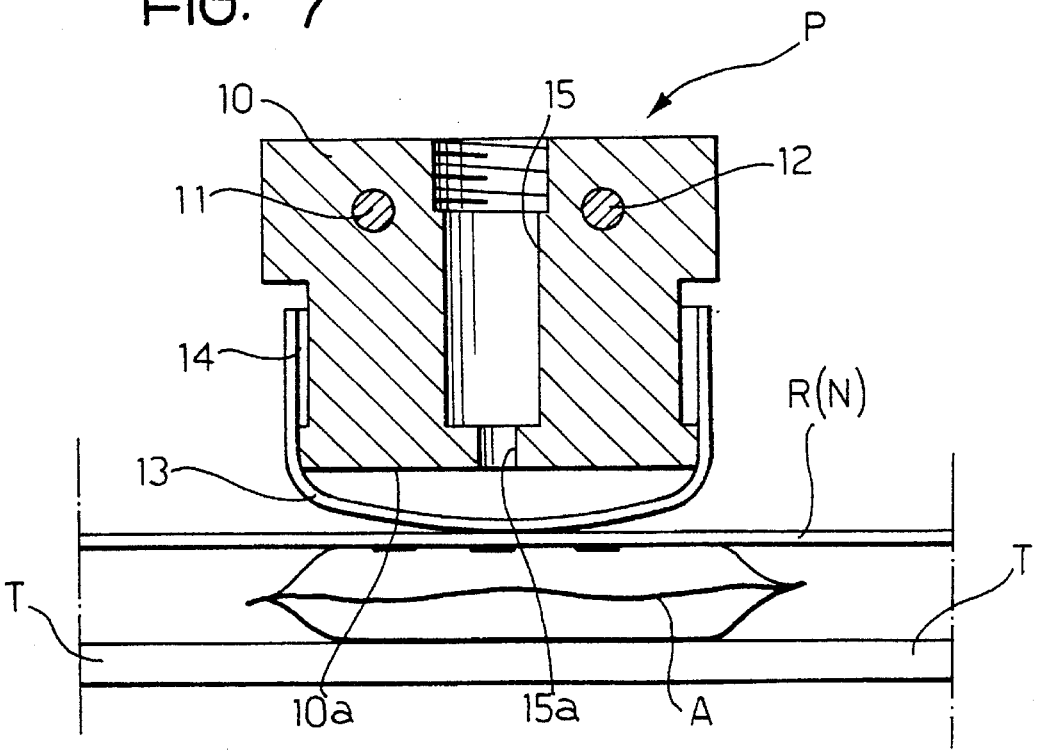

As regards the thermal pad transfer device P, this may conveniently be formed in the manner which will now be described with reference to FIGS. 6 and 7.

This device comprises essentially a body 10 made of a metallic material which is a good conductor of heat, such as aluminium or alloys thereof, associated with a resistive electric heating device 11 and a temperature sensor 12 constituted, for example, by a thermocouple.

The edge of a membrane 13 of resilient material which covers the lower end face 10*a* of the body 10 is anchored to the side walls of the body 10. The membrane may be made, for example, of a silicone material and is thin, for example 2 mm thick. The membrane is conveniently anchored to the body 10 with the interposition of a layer of a glue 14, for example, a silicone glue. Alternatively, the membrane 13 may be anchored to the body 10 by other known methods, for example, by a fixing band or ring.

The metal body 10 has an axial duct 15 with at least one opening 15*a* in its end face 10*a* which faces the membrane 13.

A tube 16 (FIG. 5), which extends within the arm F and from there into the support structure M, connects the duct 15 in the body 10 to an electro-pneumatic operating unit, indicated 20 in FIG. 5, carried by the support framework G. This unit is controlled by the control unit included in the control console C and, in particular, can apply a pressure and a vacuum alternately to the duct 15 of the pad transfer device P.

When a vacuum is applied to the duct 15 in the body 10, the membrane 13 is in close contact with the outer surface of the body. In this condition, the body 10, which is heated by the device 11 to a temperature, for example, of 150° C., transfers heat to the membrane 13.

In order to print an image from the ribbon R on an article A, the arm F is brought to its lowered position by the operation of the cylinder 52. In this position, the membrane 13, which is still adhering to the metal body 10, is a short distance from, or even in contact with, an underlying article A. Compressed air is then supplied to the duct 15 in the body 10 to move the membrane 13 away from the body so as to heat the ribbon R and at the same time to press it against the underlying article A as shown in FIG. 7.

Upon completion of the printing, a vacuum is again applied to the duct 15 in the body 10 so as to bring the membrane 13 back into contact with the end face 10*a* of the body. The arm F is also returned to its raised position.

As an alternative to the solution described above with reference to FIGS. 6 and 7, the thermal pad transfer device P may comprise a metal body which is associated with one or more electric heaters and to which a membrane is fixed. In this case, a mass of a fluid or pasty material which is a good conductor of heat is interposed between the lower surface or face of the metal body and the membrane. This solution is simpler since it avoids the need for a device to change the position of the membrane relative to the end face of the metal body.

Figure 8:
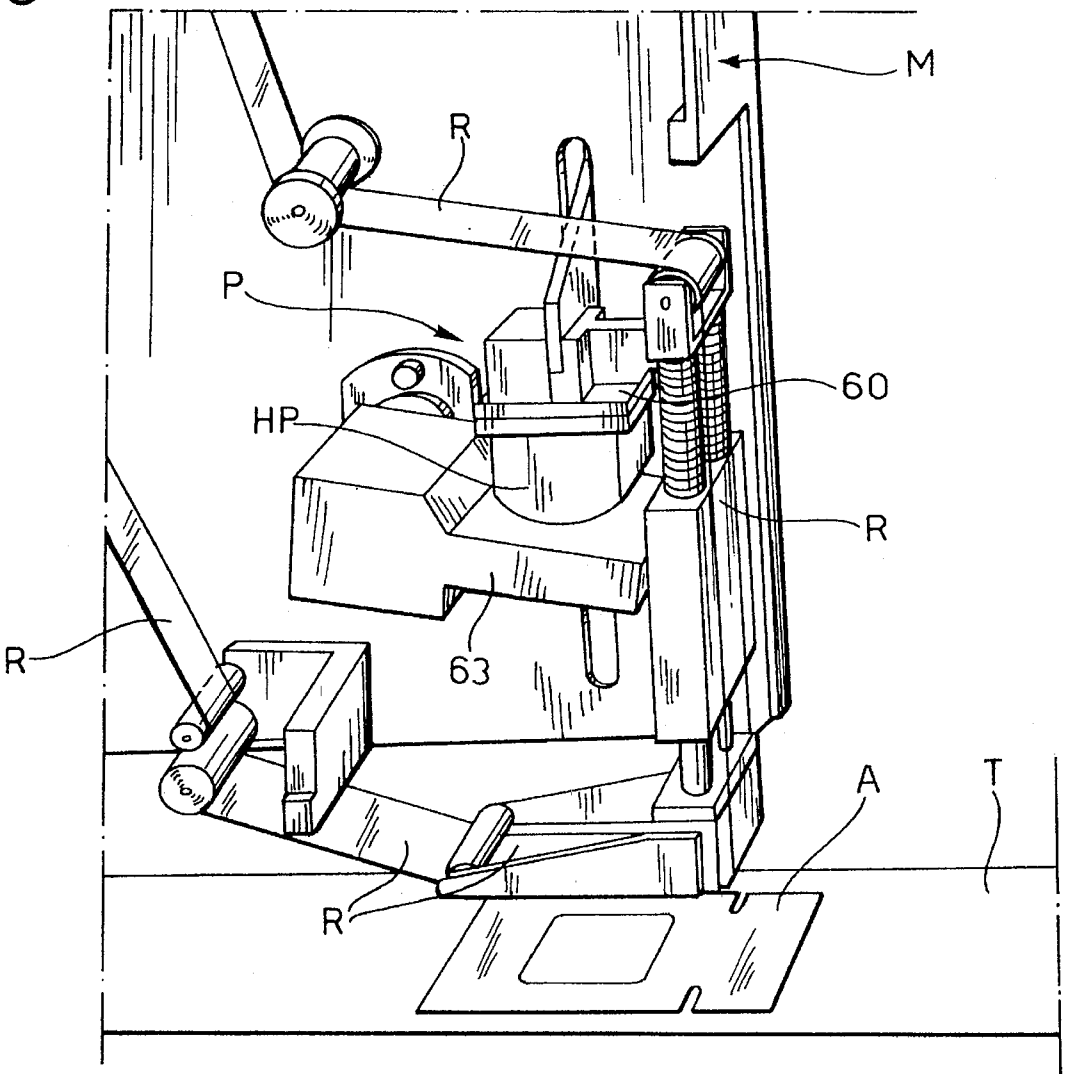
FIGS. 8 and 9 are partial perspective views showing a variant of a thermal transfer device with a heating pad in two different operative conditions.
Figure 10:
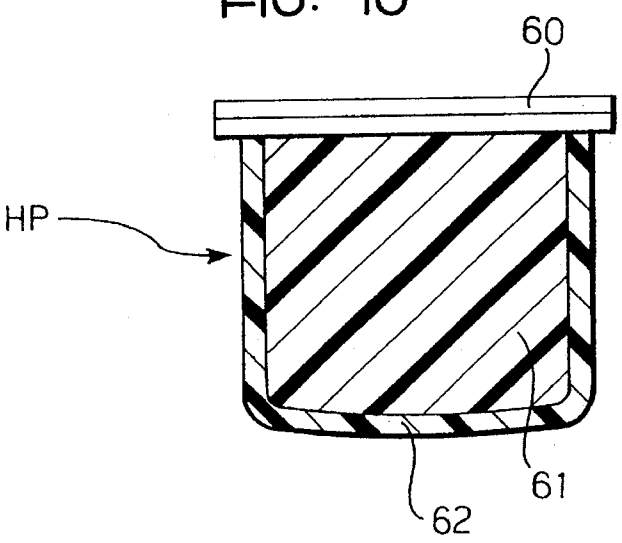
FIG. 10 is a sectioned view of a pad used in the thermal transfer device of FIGS. 8 and 9, and FIGS. 11 and 12 are partial perspective views of a further variant of a thermal transfer device in two different operative conditions.
Figure 9:
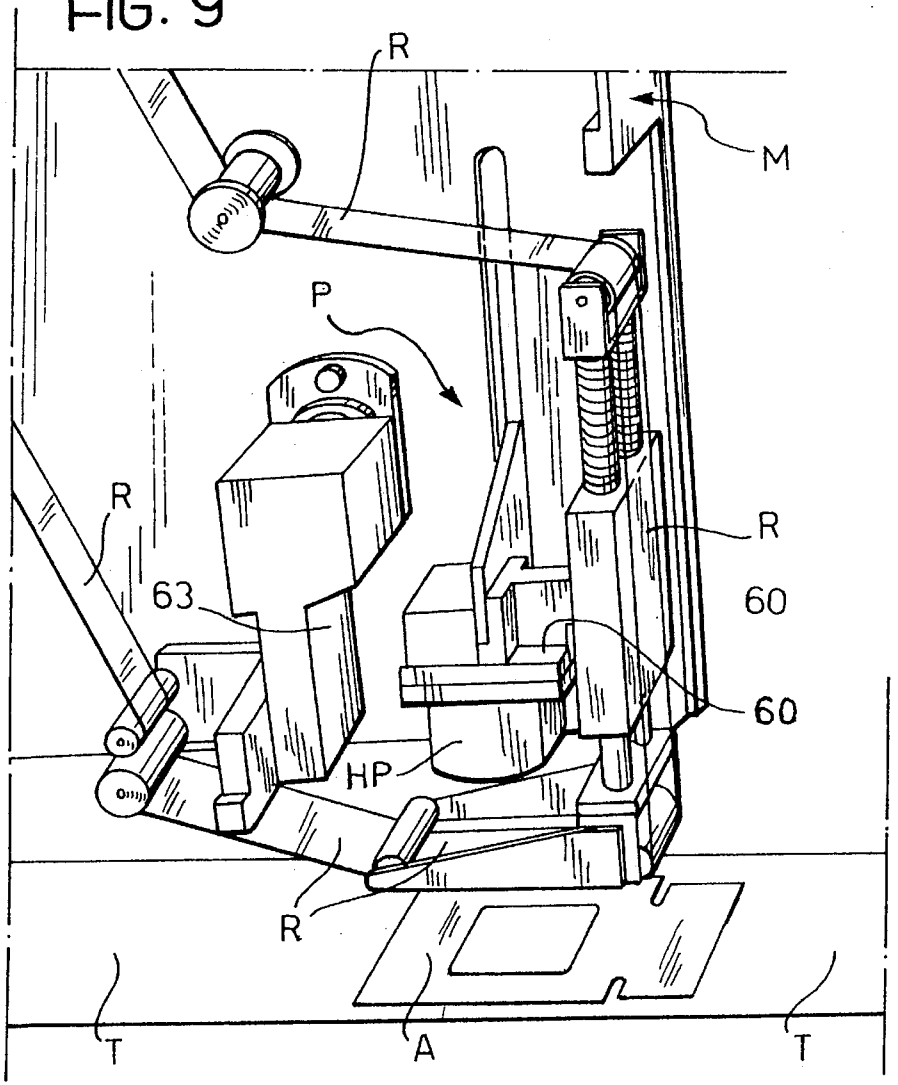

FIGS. 8 to 10 show a first variant of the thermal pad transfer device P. In this variant, the device comprises a pad HP of soft material carried below a support 60 which can be moved vertically relative to the structure M between a raised rest position (FIG. 8) and a lowered, printing position (FIG. 9) by means of an actuator (not shown) controlled by the unit C.

As shown in FIG. 10, the pad HP may comprise a block 61 of soft, thermally-insulating silicone material covered by a membrane 62 of relatively hard, thermally-conductive silicone material.

A heater 63 connected for pivoting on the support structure M includes, for example, a heating resistor and a temperature sensor (not shown), which are connected to the control unit C. The heating device 63 is kept constantly hot in use. In particular, it can assume a working position (FIG. 8) in which it is disposed in contact with the lower face of the pad HP in its raised position in order to exchange heat therewith.

The heating device 63 can be moved, by means of an actuator, not shown, controlled by the unit C, to a waiting position (FIG. 9) in which it allows the pad HP to move between its raised and lowered positions in order to transfer an image previously formed on the ribbon R in one of the ways described above onto an underlaying article A.

When the pad HP returns to its raised position after printing, the heating device 63 is returned to the working position (FIG. 8) in order to supply heat to the membrane 62 of the pad HP for the thermal-transfer printing of a new image.

Figure 11:
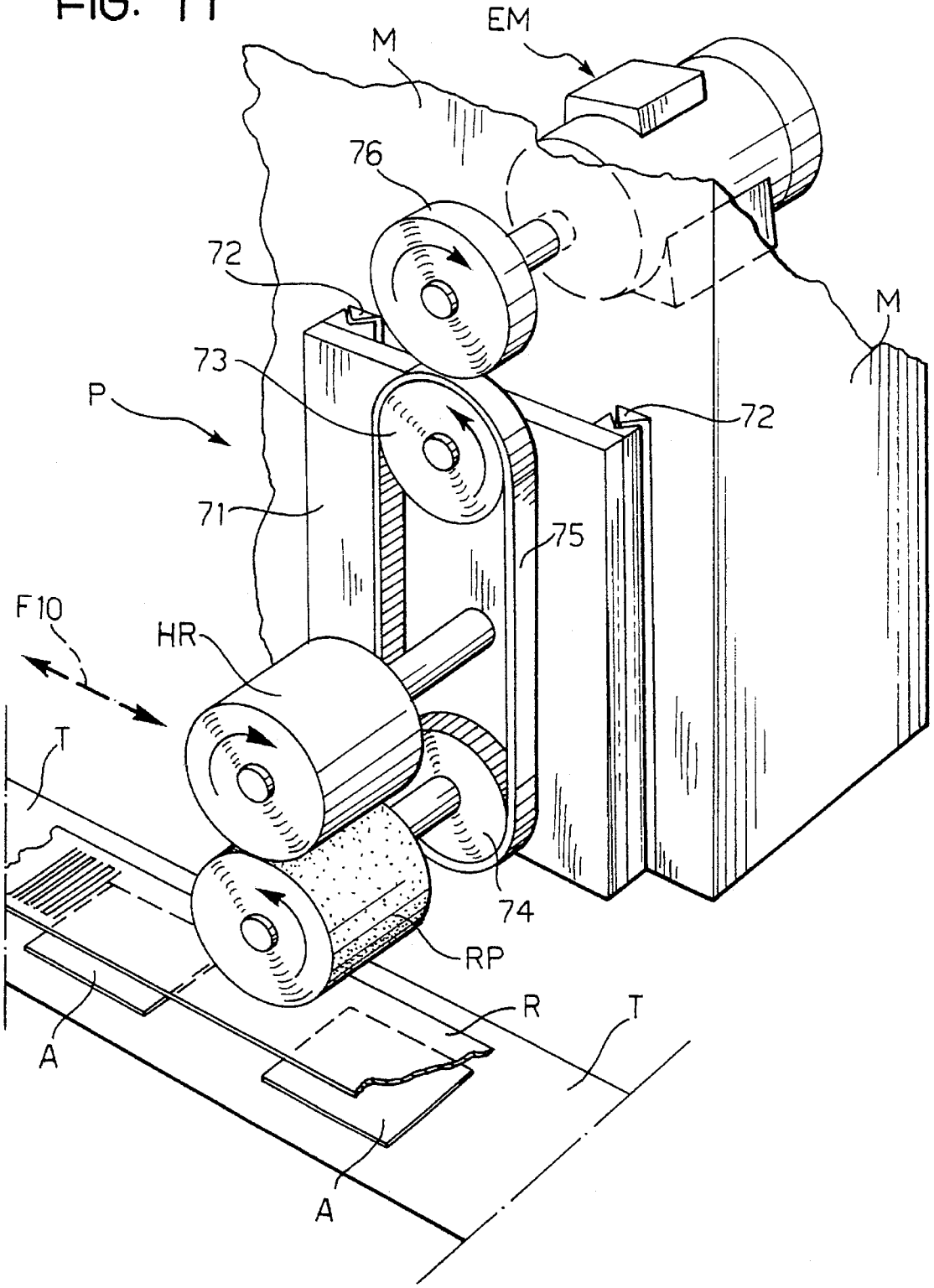
Figure 12:
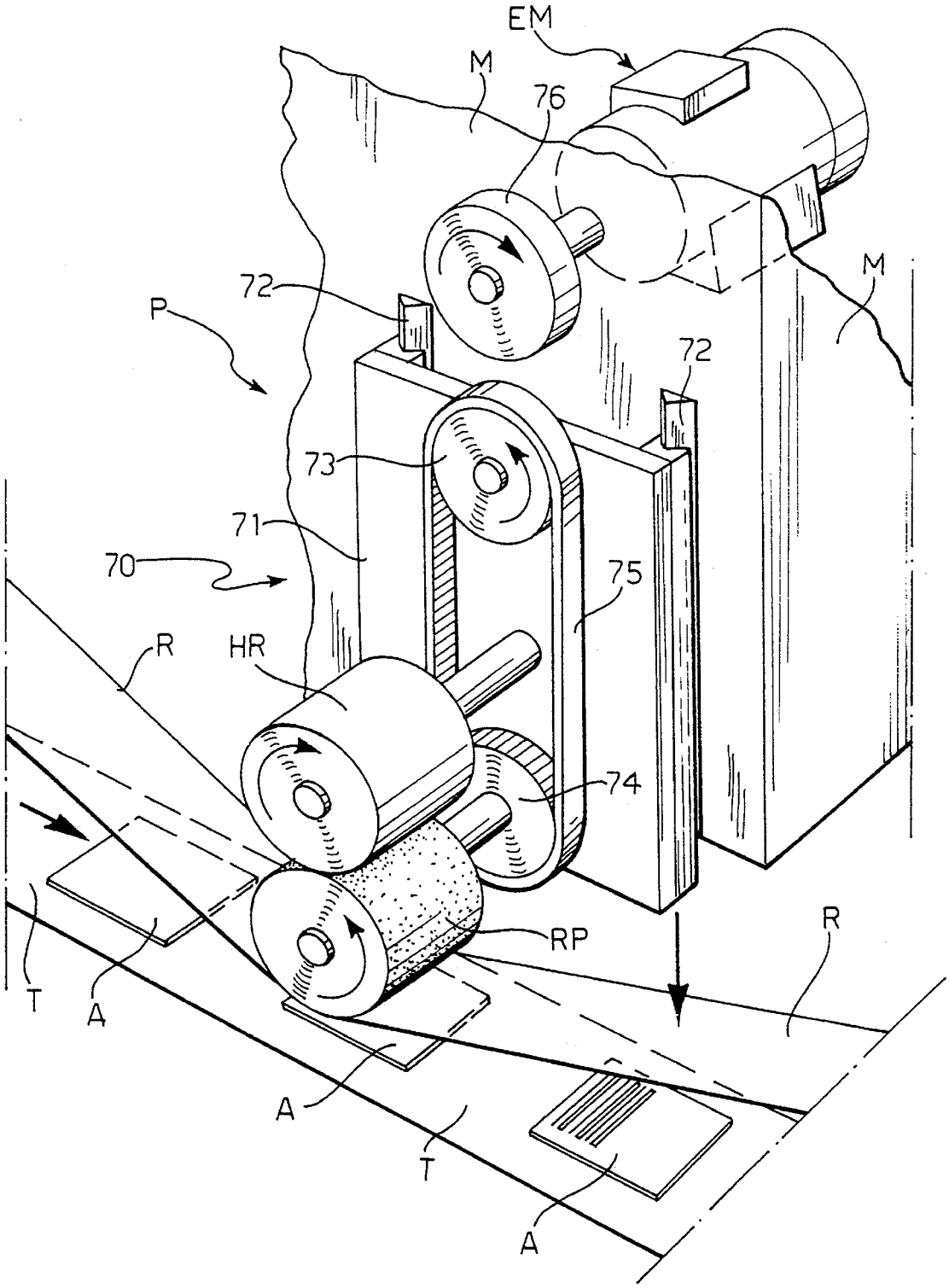

FIGS. 11 and 12 show a further variant of the heat-transfer device P.

In this variant, the device comprises a unit 70 which is movable vertically relative to the support structure M. This unit comprises a plate 71 which is slidable on vertical guides 72 and carries two idle pulleys 73, 74, and upper pulley and a lower pulley, respectively, connected by a belt 75. A roller pad RP is fixed for rotation with the lower pulley 74 and comprises, for example, a core of thermally-insulating material covered by a layer of thermally-conductive silicone material. Between the pulleys 73 and 74, the plate 71 carries a further idle roller HR, the surface of which touches the roller pad RP along a generatrix. The roller HR is heated, for example, by means of resistors incorporated therein (and not shown).

An electric motor, indicated EM, is supported in a fixed position in the structure M. The shaft of the motor carries a wheel 76 which extends above the pulley 73. The unit 70 can assume a raised, waiting position (FIG. 11) and a lowered, printing position (FIG. 12). In the raised position, the belt 75 is pinched between the wheel 76 and the pulley 73. In this condition, the rotation of the shaft of the motor EM rotates the roller pad RP, by means of the belt 75 and the pulleys 73 and 74, and the roller pad RP in turn rotates the heating roller HR. When the unit 70 is in the raised, waiting position, the roller HR consequently keeps the surface of the roller pad RP hot at a predetermined mean temperature.

In order to transfer an image from the inked ribbon R to an underlying article A, the unit C moves the unit 70 downwards (FIG. 12) (by means of an actuator, not shown); this disconnects the unit from the motor EM. When the roller pad presses the ribbon R onto the underlying article A, the ribbon R rotates the roller RP by friction. An image is thus transferred thermally from the ribbon R to the article, under pressure.

Upon completion of this operation, the unit C returns the unit 70 to the raised position of FIG. 11.

The embodiment described with reference to FIGS. 11 and 12 is particularly suitable for transferring images of considerable length.

According to a variant, in the embodiment of FIGS. 11 and 12, the unit including the motor EM, the pulley 76, the guides 72, the plate 71 and the devices associated therewith may be made movable in a controlled manner relative to the stationary support structure in directions perpendicular to the plane defined by the axes of the rollers HR and RP, that is, in the directions indicted by the broken double arrow F10 in FIG. 11.

Naturally, the principle of the invention remaining the same, the forms of embodiment and details of construction may be varied widely with respect to those described and illustrated purely by way of non-limiting example, without thereby departing from the scope of the present invention.

Thus, for example, in order to carry out the method of the diagrams of FIGS. 1 and 2, the inked ribbon R and the auxiliary ribbon N may reach the printing head H from a single unwinding roller or reel onto which both ribbons are wound.

What is claimed is:

1. Equipment for printing an image on articles, comprising:

a support structure disposed adjacent a path along which the articles are moved, said support structure containing:

guided supply means for advancing a ribbon having an inked surface and a non inked surface along respective predetermined paths defined by said guided supply means which are adjacent each other at least in a predetermined region;

a thermal dot printing head disposed in said predetermined region;

control means for controlling the printing head to selectively transfer an ink image from the inked surface to the non inked surface in the predetermined region; and a thermal transfer device having a heated pad with a movable active surface disposed in a position operatively facing the path of the articles;

wherein said control means control the printing head to form a positive ink image to be printed on an article on one of said inked surface and non inked surface; and wherein part of one of said paths of said guided supply means extends between the active surface of the thermal transfer device and the path of the articles, downstream of the printing head; and actuator means for moving the active surface of the heated pad towards an article in order to transfer ink thermally from one of said surfaces onto the article under pressure;

wherein the thermal transfer device is carried by an arm which can pivot relative to the support structure and the actuator means comprises means for causing the arm to move between a raised, rest position and a lower position for printing the image on the articles.

2. Equipment for printing an image on articles, comprising:

a support structure disposed adjacent a path along which the articles are moved, said support structure containing:

guided supply means for advancing a flexible ribbon having an inked surface and a non inked surface along respective predetermined paths defined by said guided supply means which are adjacent each other at least in a predetermined region;

a thermal dot printing head disposed in said predetermined region;

control means for controlling the printing head to selectively transfer an ink image from the inked surface to the non inked surface in the predetermined region; and a thermal transfer device having a heated pad with a movable active surface disposed in a position operatively facing the path of the articles;

wherein said control means control the printing head to form a positive ink image to be printed on an article on one of said inked surface and non inked surface; and wherein part of one of said paths of said guided supply means extends between the active surface of the thermal transfer device and the path of the articles, downstream of the printing head; and actuator means for moving the active surface of the heated pad towards an article in order to transfer ink thermally from one of said surfaces onto the article under pressure;

wherein the thermal transfer device comprises a conductor body of thermally-conductive material, associated with controlled heating means and having a main face associated with a membrane of resilient material which is intended to be brought into contact with the inked surface which carries the positive image to be transferred to the article; the membrane being fixed to the body in a manner such that the membrane can adopt, relative to the main face of the body:

a first position in which the membrane adheres to the main face and can be heated by the body, and a second position in which the membrane is moved away from the face of the conductive body and can contact the flexible ribbon in order to transfer the positive image thermally onto an article; operating means being provided for moving the membrane from said first position to said second position and vice versa.

3. Equipment according to claim 2, wherein the conductor body has at least one duct which opens in the main face, and the operating means include means for supplying the duct selectively with a fluid under pressure to move the membrane from said first position to said second position.

4. Equipment according to claim 3 comprising means for applying a vacuum to the at least one duct in order to move the membrane from said second position to said first position.

5. Equipment according to claim 2, wherein the membrane is made of a thermally-conductive silicone material.

6. Equipment according to claim 2, wherein the conductor body is made of aluminum or an alloy thereof.

7. Equipment for printing an image on articles, comprising:

a support structure disposed adjacent a path along which the articles are moved, said support structure containing:

guided supply means for advancing a ribbon means having an inked surface and a non inked surface along respective predetermined paths defined by said guided supply means which are adjacent each other at least in a predetermined region;

a thermal dot printing head disposed in said predetermined region;

control means for controlling the printing head to selectively transfer an ink image from the inked surface to the non inked surface in the predetermined region; and a thermal transfer device having a heated pad with a movable active surface disposed in a position operatively facing the path of the articles;

wherein said control means control the printing head to form a positive ink image to be printed on an article on one of said inked surface and non inked surface; and wherein part of one of said paths of said guided supply means extends between the active surface of the thermal transfer device and the path of the articles, downstream of the printing head; and actuator means for moving the active surface of the heated pad towards an article in order to transfer ink thermally from one of said surfaces onto the article under pressure;

wherein the thermal transfer device comprises:

a the pad carried by a support member which is movable relative to the structure between a retracted portion rest position and an advance printing position, a heating device which is supported movably in the structure and can adopt a working position in which the heating device can be arranged to exchange heat with the active surface of the heated pad when the heated pad is in said retracted position, and a rest position in which the heating device allows the pad to move between said retracted and advance printing positions.

8. Equipment for printing an image on articles, comprising:

a support structure disposed adjacent a path along which the articles are moved, said support structure containing:

guided supply means for advancing a ribbon having an inked surface and a non inked surface along respective predetermined paths defined by said guided supply means which are adjacent each other at least in a predetermined region;

a thermal dot printing head disposed in said predetermined region;

control means for controlling the printing head to selectively transfer an ink image from the inked surface to the non inked surface in the predetermined region; and a thermal transfer device having a heated pad with a movable active surface disposed in a position operatively facing the path of the articles;

wherein said control means control the printing head to form a positive ink image to be printed on an article on one of said inked surface and non inked surface, and wherein part of one of said paths of said guided supply means extends between the active surface of the thermal transfer device and the path of the articles, downstream of the printing head; and actuator means for moving the active surface of the heated pad towards an article in order to transfer ink thermally from one of said surfaces onto the article under pressure;

wherein the thermal transfer device comprises:

a roller pad which is rotatable and movable relative to the support structure and which has a covering of a thermally-conductive material, a heating device which can exchange heat with a surface of the roller pad, first means for rotating the roller pad in contact with the heating device, and second means for moving the roller pad between a raised, waiting position and a lowered, printing position.

9. Equipment according to claim 8, wherein the heating device comprises a heating roller which can rotate in contact with the surface of the roller pad.

10. Equipment according to claim 8, wherein the thermal transfer device can move substantially horizontally relative to the support structure.

* * * * *